United States Patent [19]

Larsen

[11] 4,315,641

[45] Feb. 16, 1982

[54] MULTI-LOOPED SKI-POLE STRAP

[76] Inventor: Greg S. Larsen, 10721 Keswick St., Sun Valley, Calif. 91352

[21] Appl. No.: 212,850

[22] Filed: Dec. 4, 1980

Related U.S. Application Data

[63] Continuation of Ser. No. 19,116, Mar. 9, 1979, abandoned.

[51] Int. Cl.[3] ..... A63C 11/22

[52] U.S. Cl. ..... 280/822; 224/219; 224/149

[58] Field of Search ..... 280/819, 821, 822; 224/54, 55, 58, 219, 220

[56] References Cited

U.S. PATENT DOCUMENTS

| | | | |
|---|---|---|---|
| 272,067 | 2/1883 | Lindsay | 224/220 |
| 774,143 | 11/1904 | Adams | 224/220 |
| 2,522,719 | 9/1950 | Johnson | 224/220 |
| 2,970,729 | 2/1961 | Allen | 224/55 |
| 3,279,008 | 10/1966 | Wallach | 224/55 UX |
| 3,294,299 | 12/1966 | Brennan | 224/220 |
| 3,451,688 | 6/1969 | McDonald | 280/821 |
| 3,540,751 | 11/1970 | Pierce | 280/822 |
| 3,880,443 | 4/1975 | Tobin | 280/821 |
| 3,982,747 | 9/1976 | Schweinsberg | 280/822 |
| 3,995,872 | 12/1976 | Joseph | 280/822 |
| 4,082,303 | 4/1978 | Finnegan | 280/822 |

FOREIGN PATENT DOCUMENTS

| | | | |
|---|---|---|---|
| 1355744 | 2/1964 | France | 224/58 |

*Primary Examiner*—Joseph F. Peters, Jr.
*Assistant Examiner*—Michael Mar
*Attorney, Agent, or Firm*—Francis X. LoJacono

[57] ABSTRACT

A multi-looped ski-pole strap arranged to be releasably disconnected from the pole and/or the skier's wrist under adverse conditions, the strap comprising an elongated, flexible, soft strip of material defined by first and second section members which are interconnected by a longitudinal, stretchable, elastic band member, providing a flexible predetermined length of strap, wherein one end thereof is formed with a small loop so as to be releasably attached to the pole adjacent the pole handle thereof, and wherein the other end is arranged to provide an enlarged releasable loop for releasable attachment around the skier's wrist by means of two opposing, cooperating, fastening-sheet-material members.

3 Claims, 6 Drawing Figures

12
15
10
22
14
25
20
26
18
24
27
44
34
16
19

27
20
14
28
32
26
24
34

27
20
28
40
32
26
14
24
34
40

38
36
27
30
20
28
42
40
14
38
32
36
26
24
34
40
42

12
46
20a
15a
10
25
26
24
18

46
20

MULTI-LOOPED SKI-POLE STRAP

CROSS-REFERENCE TO RELATED APPLICATION

This is a continuation of application Ser. No. 019,116 filed on Mar. 9, 1979, entitled MULTI-LOOPED SKI-POLE STRAP, Greg S. Larsen, Inventor now abandoned.

BACKGROUND OF THE INVENTION

1. Field of the Invention

This invention relates generally to a releasable ski-pole strap means, and more particularly to a safety, releasable, ski-pole strap device that includes a multi-looped releasable strap adapted to disconnect from the pole and/or the skier's wrist under any adverse conditions and at any angle of stress applied thereto.

2. Description of the Prior Art

As is well known in the art, various problems and difficulties are encountered in providing suitable means for releasably attaching ski poles to a skier's wrists, particularly under adverse and abnormal conditions.

Several types of releasable devices have been unsuccessfully tried, and others are presently being used that still do not provide the most efficient operable modes, and/or are operable only when stress is placed thereon under specific conditions. Many of these devices are very expensive to manufacture.

Various ski-pole attachments comprising handgrips, break-away handgrips, straps, and break-away straps are disclosed, for example, in U.S. Pat. Nos. 3,378,273; 3,451,688; 3,880,443; 3,540,751; 3,982,747 and 3,995,872.

Originally, straps were permanently fastened to the handgrips or to the ski-pole itself. This was to prevent the skiers from losing their ski-poles when they fell while skiing. However, the skier soon realized that, if the ski-pole was accidently engaged in an obstruction, it could very readily cause injury to a wrist, finger, arm or shoulder, since the strap was unyieldingly anchored to the pole and the skier's wrist.

Thus, many devices have been created to also protect the skier, as indicated in the above-identified issued patents. Hence, numerous developments have occurred in break-away handgrips and break-away straps; but—due to either complexity of design, expensive material, or high labor costs—they have not generally met with public approval or use. Other units have been designed with mechanical parts that can break, jam-up, or easily be lost if the skier takes a hard fall.

Most break-away handgrips or break-away strap devices have some type of hard and hazardous material (such as metal, wood or hard plastic) that could also cause injury to the skier while the device is being released, or if the skier should fall on the device. Also, the majority of break-away straps and grips are force-fitted, which presents some difficulty for a young skier while applying and releasing the device. Another problem with the straps presently on the market is that they do not have a suitable releasable loop to fit the wrist area. Thus, if the skier should accidentally get a tree branch caught in the loop, it could possibly cause serious injury. Furthermore, the majority of break-away straps or grips will only release in a certain direction, angle, or axis from the ski-pole, thus again posing the problem of possible injury to the skier.

SUMMARY OF THE INVENTION

The present invention comprises a multi-looped ski-pole strap device capable of being releasably disconnected from the pole and/or from the skier's wrist. The ski-pole strap is defined by a first elongated member section interconnected to a second elongated member section, the interconnecting means being a band of elastic material that is capable of stretching longitudinally. The first member section includes a releasable loop formed by mating releasable connecting members secured to the first section. The loop formed thereby receives the upper end of the pole adjacent the handle grip, the second and largest loop being formed in the second strap section, wherein the free end thereof is provided with a strip of fastening material which is arranged to be attached to a cooperating material secured to the first section, adjacent the elastic band. However, each free end of each section is provided with an extended piece defining a pull tab to manually disconnect each loop.

In an alternative arrangement, it is contemplated that the smaller loop of the first section can be established by providing a longitudinal slot to allow the first section to pass therethrough, thus creating an adjustable and slidable loop so as to be easily opened to pass over the hand grip member, and then closed about the pole.

OBJECTS AND ADVANTAGES OF THE INVENTION

The present invention has for an important object to provide a multi-looped ski-pole strap, wherein the strap includes at least one releasable connection arranged by opposing matable connecting sheet materials that will disconnect from each other under any adverse condition so as to readily free the ski-pole from the skier's wrist, without injury to the skier.

It is another object of the invention to provide a multi-looped ski-pole strap that is capable of allowing the pole and/or wrist of the skier to be released during a fall, releasable tab members being provided at each loop connection.

It is still another object of the invention to provide a releasable, multi-looped, ski-pole device that is constructed of soft flexible material, forming an elongated strap wherein one end thereof is releasably attached to the ski-pole adjacent the handle, while the opposite end thereof is releasably attached to the skier's wrist and is defined by an enlarged end loop having a stretchable band disposed therein to allow the loop to readily accommodate various sizes, even when a glove is worn on the hand of the skier, the strap being designed not to have any mechanical parts or materials that can break or become lost on the impact of a skier's fall, or while transporting the skis in an automobile, airplane, etc.

It is a further object of the invention to provide a releasable strap device of this character that has a predetermined length, the shortest length possible being employed so as not to upset the aero-dynamics of the ski-pole caused by excess drag of material.

It is still a further object of the present invention to provide a device of this character that is easy to maintain, that is relatively inexpensive to manufacture, and yet is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE PREFERRED EMBODIMENT

Figure 1:
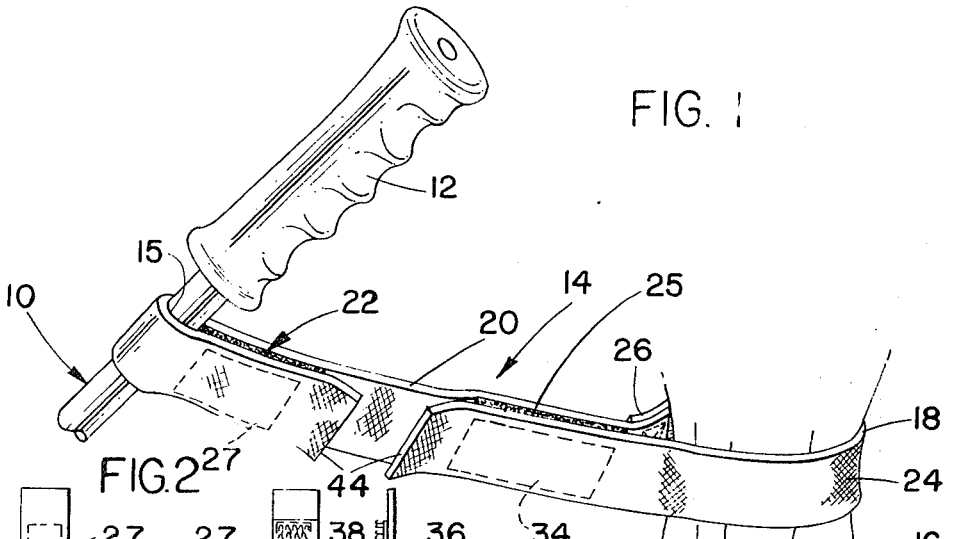
FIG. 1 is a pictorial view of the present multi-looped safety strap attached to a skier's wrist and to a ski-pole adjacent the pole handgrip.
Figure 2:
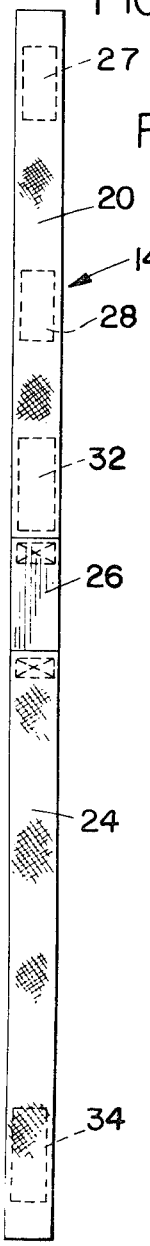
FIG. 2 is a front-elevational view of the elongated strap, without the loops formed thereon.
Figure 3:
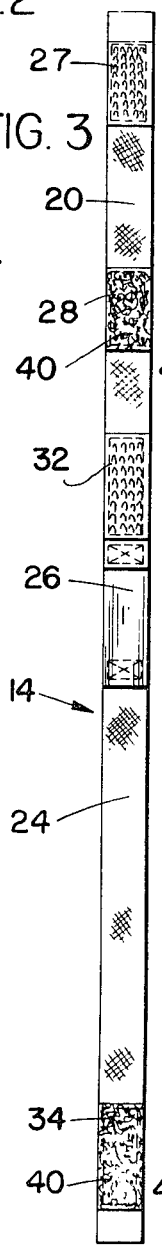
FIG. 3 is a rear view therof, showing the locations of the releasable connecting sheet members.
Figure 4:
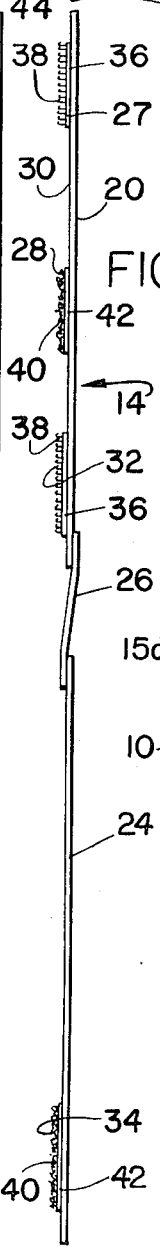
FIG. 4 is a side-elevational view therof.

Referring more particularly to FIG. 1, there is shown the upper end of a ski pole, designated at 10, having a typical handle-grip member 12 secured thereto. The present invention—a multi-looped, releasable, ski-pole strap—is generally designated at 14 wherein one end is releasably attached to the ski-pole 10 by a first loop 15, and the opposite end thereof is also releasably attached to the wrist 16 of the skier by an enlarged loop 18 formed thereon.

The multi-looped, releasable, ski-pole strap comprises are elongated, flexible, soft strip of at least one material, but preferably having a first section member 20 which includes releasable fastening means, generally indicated at 22, and a second section member 24 which also includes a second releasable fastening means, indicated generally at 25. Interconnecting the first section to the second section is an elastic means comprising an elongated elastic band 26.

Accordingly, the first section 20 is formed of a soft, flexible, cloth-like material of a predetermined length which is folded about itself at the free end thereof, and thereby defines the first loop 15 which is adjusted to the diameter of the ski pole 10, as seen in FIG. 1. Thus, in order to secure loop 15 around pole 10, a first fastening means 22 is provided, which can be any known suitable releasable device. However, the applicant prefers that a fastening means such as Velcro (trademark) material be employed, whereby loop 15 may be easily opened for release of pole 10 under any applied force to the pole or the strap. The first fastening means as herein illustrated includes a male and a female cooperating member, 27 and 28, respectively. It should be noted that for illustratve purposes male member 27 is shown affixed to the free end of section 20, and female member 28 is positioned intermediate the ends thereof, allowing area 30 between the fastening members 27 and 28 to form loop 15. When necessary, loop 15 can vary in size according to the relative positioning and coupling between fastening members 27 and 28, and thereby provide for the accommodation of different sizes and shapes of ski-poles.

Referring now to the forming of the second loop 18, the second fastening means 25 is arranged in the same manner as the first fastening means, wherein two cooperating members are coupled together. One cooperating member, such as male connector 32, is secured to the inner face of the first strap section 20 adjacent the end connected to elastic band 26, and the female connector 34 is attached to the inner side of the second section strap 24 adjacent the free end of section 24. It is important to note that connecting members 27 and 28 are located on the first section strap 20, and that one connecting member of the second fastening means is attached to the first section 20 and the other connecting member is attached to the second section. Due to the location of connecting members 32 and 34, elastic band 26 is positioned to form part of the larger loop 18. By including the elastic band within the defined loop 18, the loop can be readily expanded to receive various sizes of hands 19, or hands that are covered with gloves, and then returned to the proper size to fit the skier's wrist.

Each male connector member comprises a fabric base 36 having outwardly projecting therefrom a multiplicity of flexible, resilient, plastic filaments—each filament forming a hook-like finger 38, these hooks being adapted to be engaged by a large number of small, closed-loop, flexible, resilient plastic fibers 40 which project outwardly from the surface of a base fabric 42 similar to base 36. The above fastening materials are shown in U.S. Pat. Nos. 2,717,437 and 3,009,235.

Thus, it can be seen that loops 15 and 18 can be readily separated to release either the pole 10 or the skier's wrist 16. To disconnect member 27 from member 28—allowing ski-pole 10 to be released—the strap may be jerked directly from the pole 10 or the pole can be jerked away from the strap, whereby the hook fingers 38 will yield and release from the mating looped fibers 40. This is true with respect to the releasing of the skier's wrist.

However, when one wants to intentionally separate the two connecting members, there is provided pull-tab members 44 defined at each free end of the respective strap sections 20 and 24. Therefore, by pulling on tab 44, the two connected members will separate, thus releasing the pole or wrist.

Figure 5:
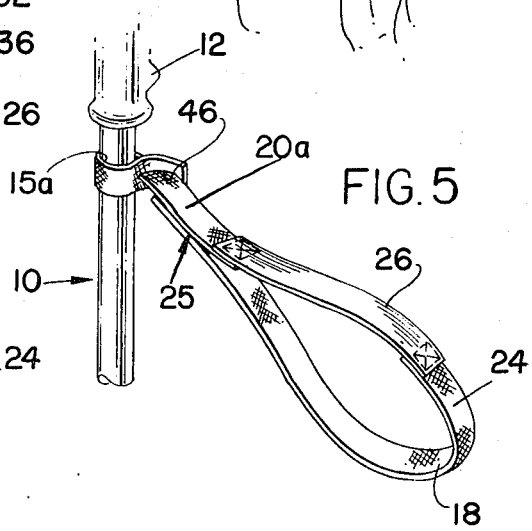
FIG. 5 is a pictorial view of an alternative arrangement of the small looped end of the strap.
Figure 6:
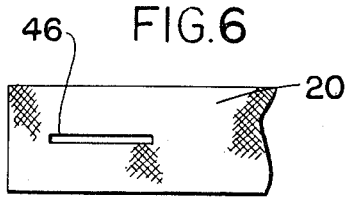
FIG. 6 is a plan view of one end of the strap as illustrated in FIG. 5, which is provided with an elongated slot.

Referring now to FIG. 5, there is shown an alternative arrangement in providing the first loop **15*a* which is adapted to receive pole 10. In this arrangement, the large loop 18 remains the same—having second section 24, elastic band 26, and fastener means 25. However, the first strap section 20*a* is altered—having an elongated slot 46 through which section 20*a* is received therethrough to define the adjustable loop 15*a*, as illustrated in FIGS. 5 and 6**. However, this arrangement only allows the wrist of the skier to be freed during an emergency.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A multi-looped, releasable ski-pole strap arranged to be releasably connected at one end to a ski pole adjacent the handle thereof, and at the opposite end to the wrist of a skier, said strap comprising:

a first elongated strap section of flexible soft material having one free attachable end and one secured end, said free end being formed to be releasably attached along said first elongated strap section to define a first loop of said multi-loops to be secured around said ski pole;

a second elongated strap section of flexible soft material having one free attachable end and one secured end, said free end being formed to be releasably attached along said first elongated strap section to define a second loop of said multi-loops to be secured around said wrist;

an elastic stretchable material interposed between said first and second strap sections, and interconnecting each secured end of said first and second strap sections, to form a predetermined length thereof;

a first releasable fastening means provided on said first strap section, whereby said first loop is formed;

a second releasable adjustable fastening means under force provided between said first strap section and said second strap section, whereby said second loop is formed; and wherein said elastic stretchable material forms part of said second loop to allow said second loop to be expanded without disconnecting said second releasably adjustable fastening means.

2. A multi-looped, releasable, ski-pole strap as recited in claim 1, wherein said first and second releasable fastening means comprise:

a male, flexible, connecting sheet material; and a female, flexible, connecting sheet material wherein said male and female connecting sheets are arranged to cooperate so as to interlock together to establish said first and second loops, said connecting sheets being releasable from each other under force, whereby said ski pole or said wrist is readily freed from the respective strap section, wherein one of said connecting sheets of said first fastening means is attached to said first strap section adjacent said free end thereof, and said other cooperating sheet is attached to said first strap section intermediate the ends thereof, whereby said first loop is defined by said first strap section, and wherein one of said connecting sheets of said second fastening means is attached to said first strap adjacent said elastic material, and said other cooperating connecting sheet is attached to the free end of said second strap section, whereby said second loop is defined between said first and second strap sections.

3. A multi-looped, releasable, ski-pole strap as recited in claim 2, wherein each free end of each strap section includes tab members arranged to be manually pulled to disconnect the respective cooperating connecting sheet materials.

* * * * *